US005632215A

United States Patent [19]

Moessnang et al.

[11] Patent Number: 5,632,215

[45] Date of Patent: May 27, 1997

[54] ROLLER REEFING BOOM SYSTEM

[76] Inventors: Joerg Moessnang, Beiselestr. 33, D-82327, Tutzing, Germany; Beat Wildberger, Burgstr. 21, CH-4125, Riehen, Switzerland

[21] Appl. No.: 326,849

[22] Filed: Oct. 21, 1994

(Under 37 CFR 1.47)

[30] Foreign Application Priority Data

Oct. 22, 1993 [DE] Germany ..... 9316178 U
Aug. 12, 1994 [EP] European Pat. Off. ..... 94112637

[51] Int. Cl.[6] ..... B63H 9/08

[52] U.S. Cl. ..... 114/104; 914/106

[58] Field of Search ..... 114/39.1, 90, 102, 114/103, 104, 105, 106, 107, 108, 112

[56] References Cited

U.S. PATENT DOCUMENTS

| | | | |
|---|---|---|---|
| 2,197,654 | 4/1940 | Beaudry | 114/107 |
| 3,260,230 | 7/1966 | Kauert . | |
| 4,597,347 | 7/1986 | Spanopoulos | 114/107 |
| 4,724,787 | 2/1988 | Chevalier et al. | 114/107 |
| 5,044,294 | 9/1991 | Kronich et al. . | |
| 5,191,851 | 3/1993 | Rutgerson | 114/112 |

FOREIGN PATENT DOCUMENTS

| | | |
|---|---|---|
| 0011582 | 5/1980 | European Pat. Off. . |
| 0229675 | 7/1987 | European Pat. Off. . |
| 77 00 888 | 3/1977 | Germany . |
| 29 41 918 | 4/1981 | Germany . |
| 32 07 133 | 11/1982 | Germany . |
| 32 13 864 | 11/1982 | Germany . |
| 84 17 077 | 10/1984 | Germany . |
| 34 42 740 | 6/1986 | Germany . |
| 90 06 731 | 10/1990 | Germany . |
| 93 16 178 | 4/1994 | Germany . |
| 613752 | 12/1948 | United Kingdom . |
| 978910 | 1/1965 | United Kingdom . |
| 1087232 | 10/1967 | United Kingdom . |

*Primary Examiner*—Stephen Avila
*Attorney, Agent, or Firm*—Oblon, Spivak, McClelland, Maier & Neustadt, P.C.

[57] ABSTRACT

A roller reefing boom system includes a mast track arrangement, a sail and a rig which permit the transfer of extremely high mainsheet tensions via the leech to the mast even with a minimum luff diameter without the luff unintentionally being pulled out of the mast slot. The system guarantees troublefree furling of the mainsail with a minimum of space.

21 Claims, 9 Drawing Sheets

ROLLER REEFING BOOM SYSTEM

BACKGROUND OF THE INVENTION

1. Field of the Invention

The invention relates to a roller reefing boom system, a mast track arrangement, a sail and a rig for use in said roller reefing boom system.

2. Discussion of the Background

During the past few years, particularly on sailing yachts of more than 40 ft in length, roller reefing systems for the mainsail have come into use, because these roller reefing systems have the advantage over the conventional jiffy reef that smaller crews are able to safely and easily reduce the sail area.

Principally two roller reefing systems are distinguished. In the case of the roller reef used most frequently at present, the sail is furled around a furling means provided in the mast profile (furling mast). This system has the drawback that the weight of the mast is increased. The increased top weight of the mast particularly entails a reduction of the righting moment so that the yacht can carry less sail area particularly on the wind.

Moreover such a construction is not adapted to make use of a full-batten mainsail, because the battens make it impossible to furl the sail around an axis parallel to the luff.

For the yachtsman this furling system has the additional drawback that the sail shape varies due to furling into the mast so that no optimum flow of the sail shape is ensured when the sail is partly reefed.

Hence, roller reefing boom systems, as they are called, have been developed in which the mainsail is furled around the boom. To this effect, the boom is fixed to a swivel-fitting and can be rotated about its axis of rotation by an actuating means. This rotation of the boom is effected by an appropriate mechanism which is manually operated in the case of smaller yachts (less than 40 ft), while on bigger yachts usually hydraulic systems are employed.

The furling boom has the advantage that also full-batten mainsails can be used, because the battens are normally disposed parallel to the axis of the boom. Moreover, when used in a roller reefing boom system, the mainsail can have a roach, especially in the top area, because the furling is effected approximately around the axis formed by the straight foot, whereas in the case of furling mast systems the leech of the sail must be substantially straight so as to guarantee even furling into the mast and a relatively effective shape of the reefed sail.

Since the means required for rotating the roller reefing boom and the furled portion of the sail are arranged relatively closely to the center of lateral resistance of the yacht, the righting moment of the sailing yacht is only slightly impaired. Thus the roller reefing boom permits, in comparison to a furling system in which the mainsail is furled into the mast, a larger sail area with the same keel weight.

In the previously known roller reefing boom systems the mainsail has been guided in a slot in the mast. In order to be able to take up the forces occurring when trimming the sail, the luff rope must have a predetermined minimum diameter so as to hold the sail reliably in the mast slot. If the luff diameter is too small, the sail may be pulled out of the slot or may be clamped in the same in the case of extreme mainsheet tensions so that it is very difficult to reduce the sail area.

A large diameter of the luff rope has the drawback that the furled sail layers are not close to one another in the luff area but need considerably more space compared to the furled sail in the leech area. This may result in an uneven furling of the mainsail.

Hence, on the one hand there is the demand to design the portion of the mainsail guided in the mast slot as strongly as possible so as to take up the occurring forces. On the other hand, there is the demand that the luff rope have an as small diameter as possible so as to ensure an optimum furling of the sail. Conventional roller reefing boom systems are not adapted to meet these contrary requirements.

SUMMARY OF THE INVENTION

Compared to this, it is the object of the invention to provide a roller reefing boom system and a mast track arrangement used therewith, a rig and a sail which ensure a troublefree reduction of the sail area even in the case of large sail areas.

This object is achieved, with respect to the roller reefing boom system, the mast track arrangement, the sail and the rig.

The tension pickup in the top area of the mainsail provided according to the present invention relieves the luff portion guided in the mast slot when the mainsheet is hauled tight. Thereby it is possible to design the luff rope with minimum diameter so that in the furled state the sail layers are adjacent even in the luff area.

This guarantees that the sail can be furled evenly on a minimum of space.

With the same outer diameter of the roller reefing boom system, a larger mandrel diameter than in conventional systems can be used in the roller reefing boom system according to the invention due to the more compact furling so that a better bending/torsional strength of the boom is ensured.

Since in the case of modern mainsails usually multi-layered cloths are used, the suitable larger boom diameter has the additional advantage that the cloth layers are prevented from delaminating due to the reduced bending of the cloth. In this manner, also sensitive hightech sails can be employed.

Due to the small diameter of the luff rope, the design of the roller reefing boom system makes very high demands on the dimensional stability of the mast slot. Particularly in the case of yachts bigger than 60 ft, the required small tolerances may cause problems, because masts having a total length of more than 30 m are used on such yachts. In this case, it is particularly advantageous to make use of a two-piece mast track arrangement according to the present invention in which the mast track is constituted by a base track to which an insert member is fixed in which the actual mast slot is formed. It has become obvious that, with regard to manufacture, it is by far easier to manufacture the comparatively small insert member with high precision which is then fastened to the base track manufactured with larger tolerances which is responsible for the actual supporting function of the mast track arrangement. This design enables the insert member to be manufactured of a plurality of comparatively short sections and subsequently to be fastened on the base track. In the mounted state the insert member covers the fastening members by which the base track is fixed to the mast so that damage of the sail luff by possible protruding parts of the fastening members is prevented.

Advantageously, the insert member is fixed to the base track through a dovetail fit.

A particularly simple design of the roller reefing boom system is achieved, if the tension pickup is realized in the form of a slide, as it is also used, e.g., as a traveller slide. The slide is then preferably guided in a roller bearing at the base member so that the frictional resistance of the slide is practically negligible when reefing or setting the mainsail.

A particularly compact furling of the sail is obtained, if the luff is pretensioned during reefing by tensioning means. This pretension of the luff safeguards that the luff and the battens are urged away from the mast during the furling operation. More particularly, the luff is furled to be spirally superimposed so that the individual sail layers are close to each other and the self-friction caused thereby in addition maintains the sail in the furled state.

Advantageously, the tensioning means interacts with the main halyard.

In a preferred embodiment the tensioning means interacts with a halyard drum for the main halyard which is adapted to be driven for rolling up the main halyard via a drive unit and a gear unit, the drive unit acting as a brake through which the pretension is applied to the halyard when reefing the sail.

The friction of the system can be reduced to a minimum, if a planetary gear is employed.

It has turned out to be especially advantageous to maintain the boom at an angle of 89.7° with respect to the axis of the mast during the reefing operation.

The diameter of the furled sail layers can be further reduced, when a sail is used in which the commonly employed rectangular batten is replaced by a group of preferably three round battens. The use of a group of round battens imparts the same stiffness to the sail shape as the use of rectangular battens. The round battens have the advantage, however, that in the furled mainsail they are received flush with the individual cloth layers and thus ensure a compact furling. Moreover only a slight bulge is formed, when two round battens happen to lie next to each other.

In accordance with an advantageous embodiment of the sail, the luff is a plastic profile in the form of a boltrope the circular portion of which constitutes the luff and in the luff tape of which a webbing may be inserted for reinforcement.

The fatigue strength of the luff can be increased by the use of polyurethane (PU) having a Shore hardness (A) of about 90.

The roller reefing boom system according to the invention has particularly little wear, if the mast is present, the bend corresponding to about 1% of the luff length. By this measure the battens are urged away from the mast slot against the effect of the mainsheet tension so that the friction at the mast and, consequently, the abrasion of the sail can be considerably reduced.

Further advantageous embodiments of the invention are also provided in the present invention.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENT

Figure 1A:
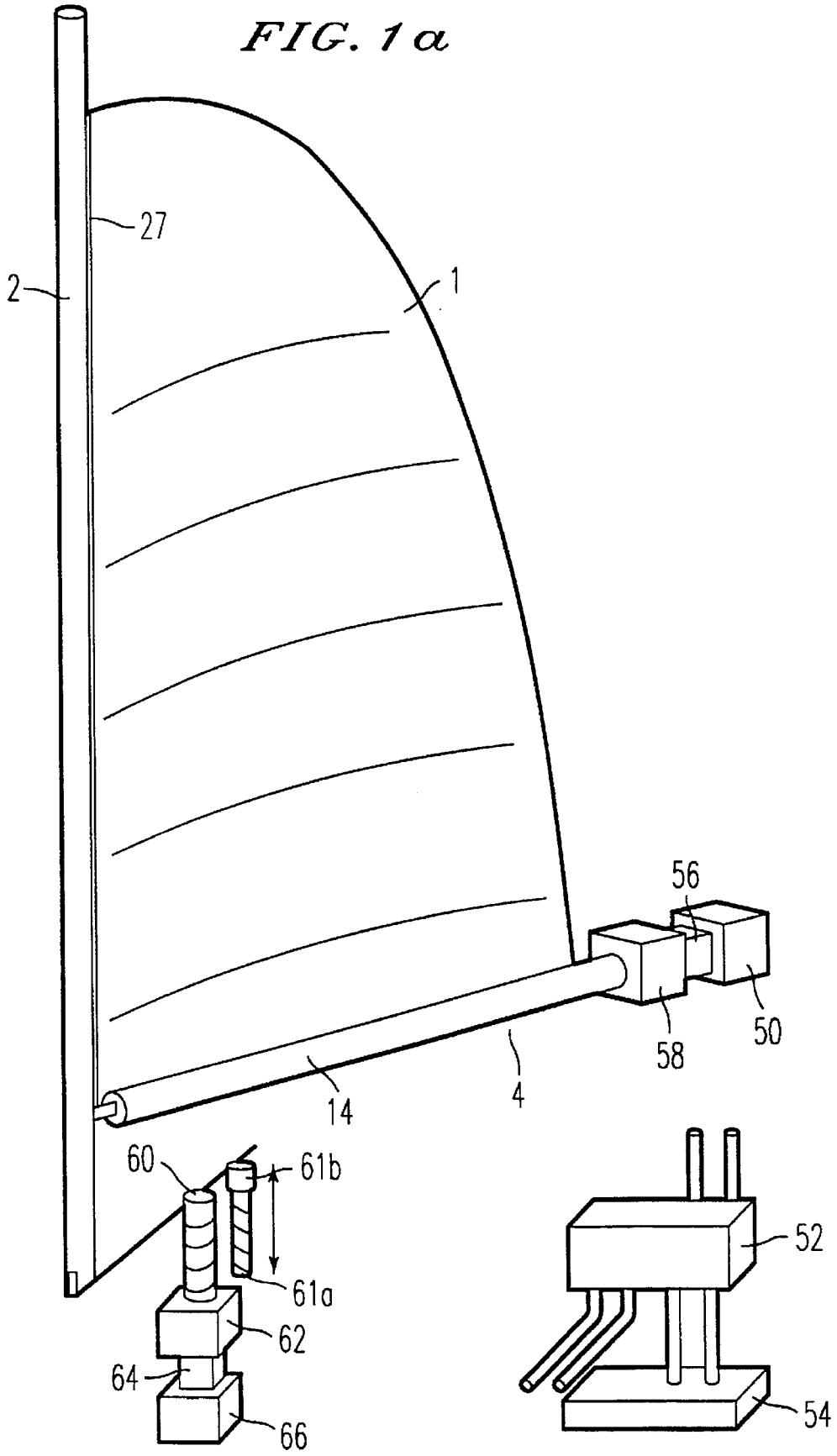
FIG. 1*a* shows a view of a hydraulically operated roller reefing boom system comprising the required drive elements.

FIG. 1*a* shows a schematic view illustrating the function of the roller reefing boom system and the drive units thereof. By means of the roller reefing boom system, referred to as reefing system in the following, a mainsail 1 the luff 27 of which is guided along a mast 2 can be furled into a main boom 4 comprising a mandrel 14 and a housing (6 in FIG. 2*a*) encasing the same into which the mainsail 1 is furled.

The reefing system shown in FIG. 1*a* is operated hydraulically and can also be employed in maxi yachts having a total length of more than 20 m. However, the system according to the invention can also be used in smaller yachts using electrically or manually operated systems.

As one can further deduce from FIG. 1*a*, the reefing system comprises a motor 50 which is supplied with hydraulic fluid via a hydraulic control 52 and a central power supply, referred to as powerpack 54. Since the individual hydraulic components are standard parts, the description thereof can be omitted. In this respect, reference is made to the suppliers' catalogues.

The motor 50 acts via a gear unit 58 on the mandrel 14 so that the latter can be rotated about its longitudinal axis to furl the mainsail 1. When the motor is not operated, the mandrel 14 can be fixed by a locking brake 56.

The setting of the mainsail 1 is likewise effected via a hydraulic unit comprising a halyard drum 60 for rolling up the main halyard, a gear unit 62 connected thereto, a locking brake 64 and a motor 66 which, in turn, can be supplied with hydraulic fluid through the hydraulic control 52.

When the motor 66 is actuated, the halyard drum 60 is rotated so that the main halyard extending inside the mast 2 is rolled up around the circumference of the halyard drum 60 and the mainsail 1 is pulled upwards. For an orderly rolling the halyard drum 60 may include a leading spindle 61*a* on which a screw socket including a halyard guide 61*b* is guided. The halyard is moved upwards and downwards via the halyard guide in the arrow direction so that the halyard is rolled up thread-like on the halyard drum 60.

When unrolling the mainsail 1, the mandrel 14 is rotated by the mainsail 1 being unrolled, whereby, due to the rotation of the mandrel 14, the motor 50 which is not supplied with hydraulic fluid when setting the mainsail 1 acts as a brake preventing the mandrel 14 from unrolling automatically and thus ensuring an orderly setting of the mainsail 1.

The two gears 58, 62 are planetary gears, because these gears have a substantially reduced self-friction compared to commonly used worm gears so that the losses of energy can be minimized.

The two brakes 56, 64 act as a locking brake so as to keep the main boom 4 and the halyard drum in their instantaneous position when the motors 50, 66 are not actuated.

For reefing the mainsail 1 the brake 64 is released and the motor 50 is controlled by the hydraulic control so that the mandrel 14 is rotated to roll up the mainsail 1 along the circumference of the mandrel. In this state of operation, the motor 66 acts as a brake so that the main halyard must be unrolled from the halyard drum 60 against the effect of the motor 66. By this pretension of the main halyard also the luff 27 of the mainsail 1 is tensioned so as to safeguard a tight furling of the mainsail 1 with closely adjoining layers onto the mandrel 14 (as regards further details of the pretension, reference is made to the following).

Hence a tension force, by which the sail is tightly rolled up and unrolled, is applied to the luff 27 and the leech of the mainsail 1 during the unrolling and rolling operation by the drive units according to the invention for the mandrel 14 and the halyard drum 60 and the brakes 64, 56. This ensures that the furled sail does not contract by the tension of the mainsheet, that the leech is not extended thereby and thus the angle 0 between the mast 2 and the main boom 4 is maintained for the furling operation.

As already mentioned in the foregoing, in the case of smaller yachts the motors for driving the mandrel 14 and the halyard drum 60 can also be constituted by electric drive units or replaced by manually operated drive units (crank mechanisms etc.).

Figure 1B:
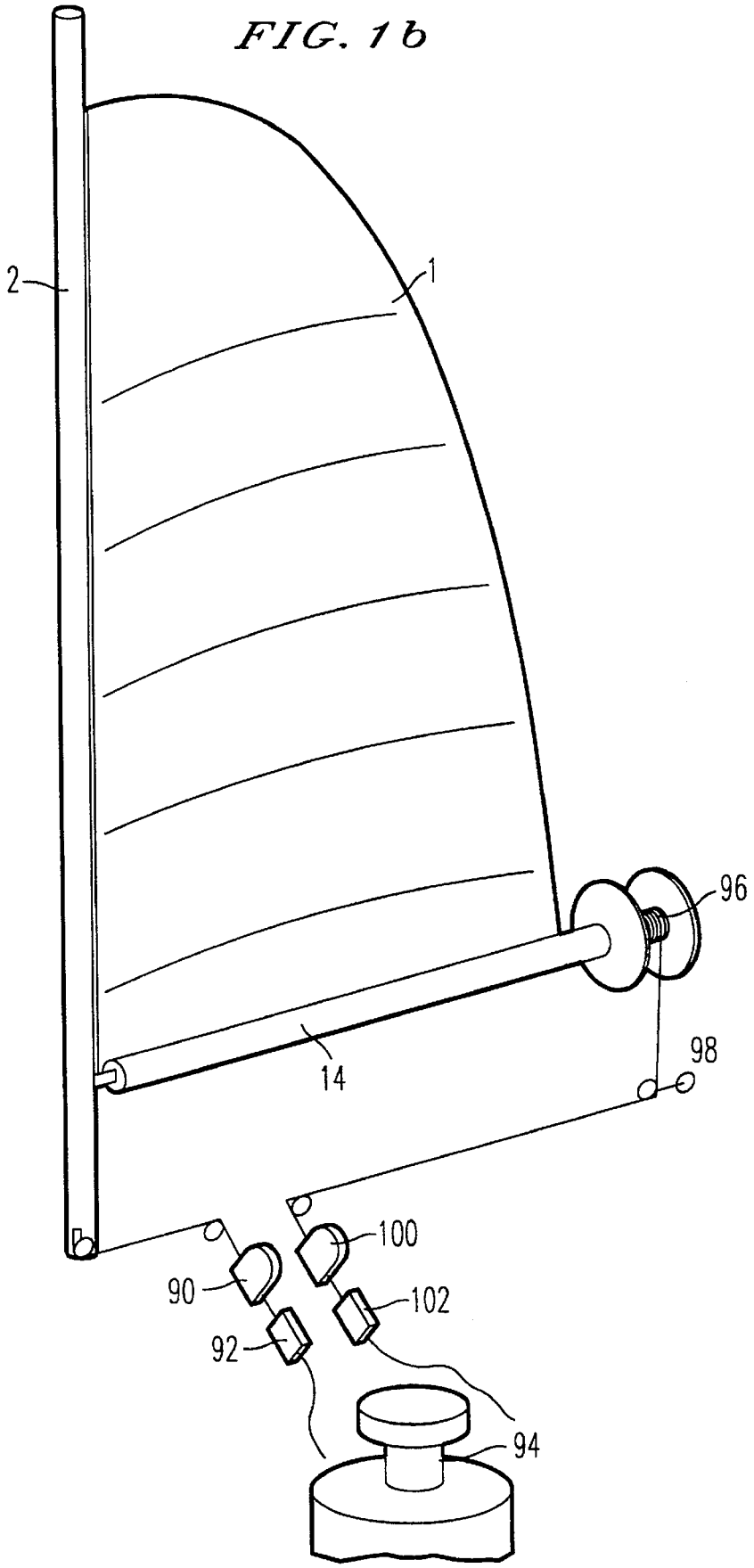
FIG. 1*b* shows a view of a manually operated roller reefing boom system comprising the required drive elements.

According to FIG. 1*b*, in such systems for smaller yachts the halyard runs over a manually operated winch 94 to which an automatic brake means 90 applying a tension on the halyard and thus on the luff when reefing the mainsail 1 is assigned. A cleat 92 for securing the halyard is assigned to the brake means 90.

As one can further take from FIG. 1*b*, at the rear end of the boom a reef line drum 96 is fixed around which a reef line guided through the reef line guide 98 to the winch 94 is wound. The reef line drum 96, in turn, is associated with a brake means 100 and a cleat 102. The reef line can be secured in its preselected position by said cleat.

For reefing the mainsail 1 the reef line is put around the manually or electrically operated winch 94, the cleat 102 is released and the reef line is unrolled from the reef line drum by the winch so that the mandrel 14 is rotated and the mainsail 1 is reefed.

As already in the case of the above-described embodiment, a predetermined tension is applied to the main halyard via the brake means 90 so that the luff tension according to the invention is brought about.

When reefing or setting the mainsail 1, the main halyard is put around the winch 94 and the cleat 92 is opened so that, when releasing the cleat 102, the mainsail 1 is unrolled from the mandrel 14. In so doing, a pretension counteracting an uncontrolled rotation of the mandrel 14 is applied via the brake means 100 when the cleat 102 is released. In the sailing position both cleats 92 and 102 are in locking position so that the main halyard and the reef line are secured.

Figure 2A:
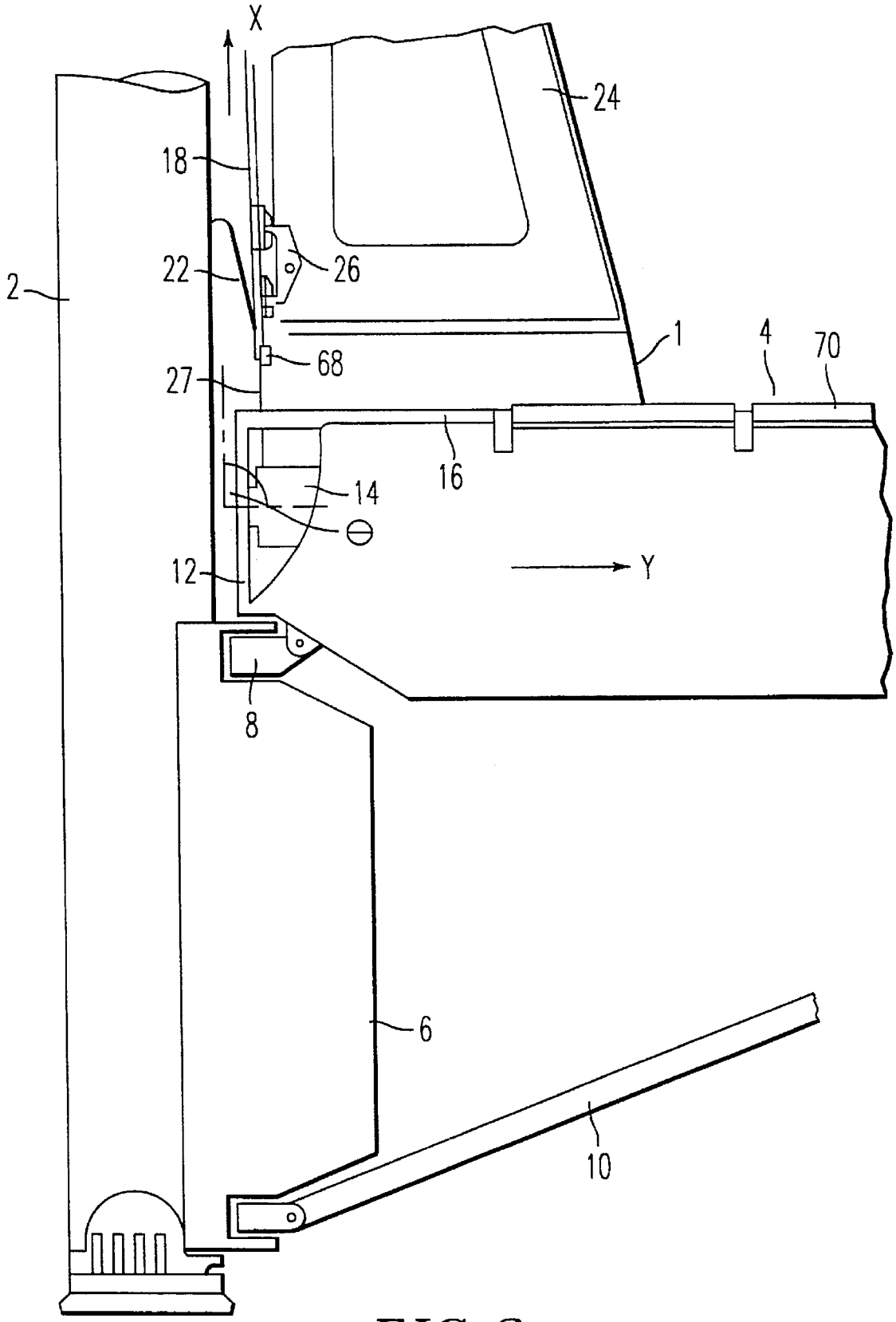
FIG. 2*a* shows a side view of a part of the roller reefing boom system.

According to FIG. 2*a*, the main boom 4 is pivoted to the mast 2 via gooseneck fittings 8. The relative position of the boom 4 to the mast 2 illustrated in FIG. 2*a* which is adjusted for setting and lowering (reefing) the sail is maintained by a boom vang 10, which is a hydraulic cylinder in the shown embodiment.

The boom 4 substantially corresponds to the designs known so far. More particularly, the gooseneck fittings 8 are fixed to a frame member 12 in which the mandrel 14 is rotatably supported about its longitudinal axis. The frame member 12 encloses the mandrel 14 in the form of a housing so that the furled mainsail is covered by the frame member 12.

At the upper end portion of the frame member 12 shown in FIG. 2*a* there is a longitudinal slit 16 through which the mainsail 1 is guided. The circumferential edges of the longitudinal slit can be provided with rollers 70 so as to prevent the sail from being damaged during rolling up and unrolling.

Figure 3:
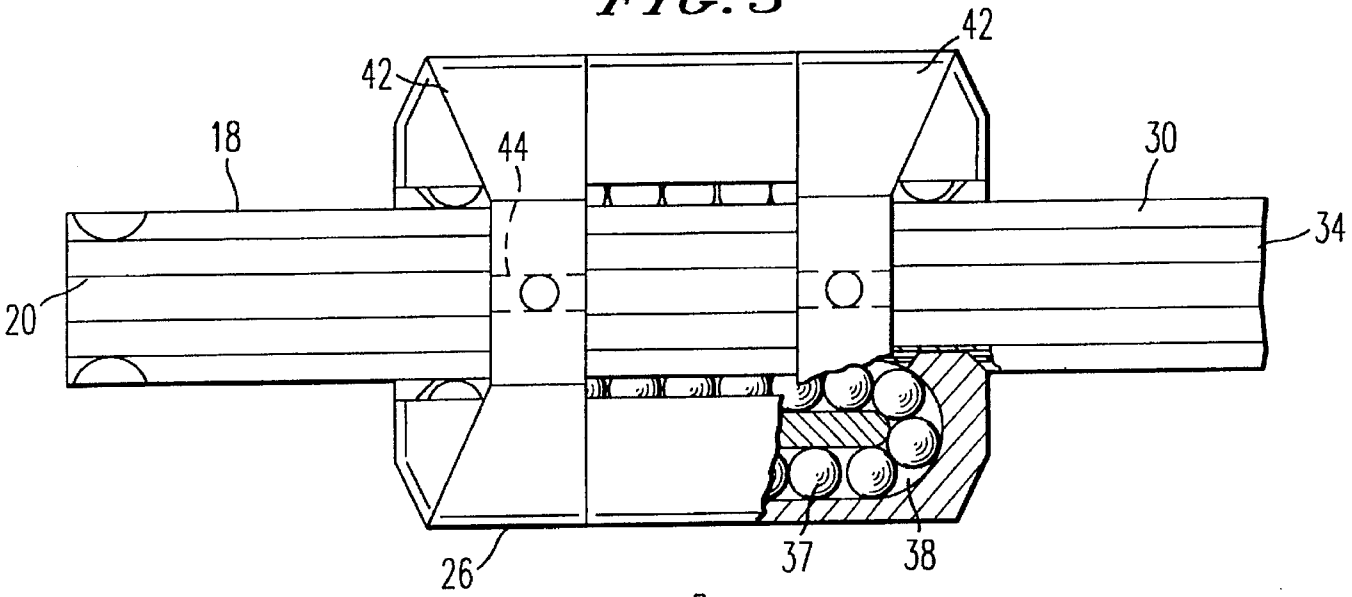
FIG. 3 shows a partly cut top view of a mast track arrangement used in a roller reefing boom system of FIG. 2.
Figure 4:
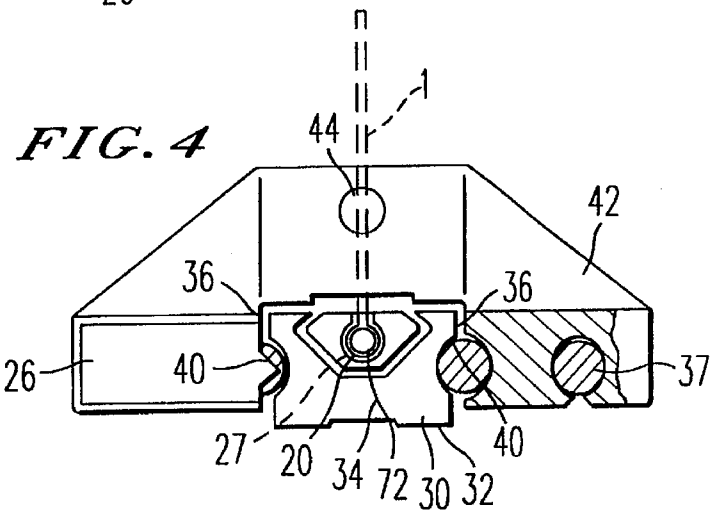
FIG. 4 shows a front view of the mast track arrangement of FIG. 3.

A small distance above this longitudinal slit 16 there starts the mast track 18 in the slot 20 of which (cf. FIG. 4) the luff 27 of the mainsail 1 is guided. The mast track 18, which is explained in more detail in FIGS. 3 and 4, is fixed to the mast 2, the lower portion of the mast track 18 shown in FIG. 2*a* being fastened to the mast by a spring element 22. That is, in the area of the spring element 22 the mast track 18 is arranged at a distance from the mast 2. This distance diminishes, however, in the direction of arrow X (FIG. 2*a*) so that after a predetermined length the mast track 18 is directly adjacent to the mast 2 and is screwed or riveted to the mast. This resilient support of the feeding area of the mast track 18 serves to align the luff 27 of the mainsail 1 during the reefing operation toward the mandrel 14, wherein the luff is kept at a distance from the mast 2 which corresponds approximately to the distance of the pivot of the gooseneck fittings 8 from the mast 2. Moreover in the feeding area there may be provided a feeder 68, for instance two rollers disposed on both sides of the luff 27 which sit close to the sail with a circumferential portion so that reliable feeding of the mainsail 1 into the mast slot 20 is guaranteed.

In the top area of the sail there is provided a headboard 24 to the upper end portion of which not shown in FIG. 2*a* the main halyard (not shown) is fixed. A slide 26 the whose support portions are guided at the side faces of the mast track 18 is fixed to the headboard 24. Regarding further details of the mast track arrangement, reference is made to the following description.

The slide 26 serves for transferring the tensile forces occurring when hauling tight the mainsheet from the mainsail 1 to the mast 2. More particularly, the luff 27 of the mainsail 1 is relieved by the slide 26.

The boom vang 10 usually has the function to prevent the main boom 4 from rising on downwind courses. In the reefing system according to the invention the hydraulic cylinder of the boom vang 10 can be fixed during setting and lowering the sail so that it acts as a support means and the boom 4 is kept at a predetermined angle θ (FIG. 2) with respect to the longitudinal axis of the mast 2. This angle θ preferably is 89.7°.

Figure 2B:
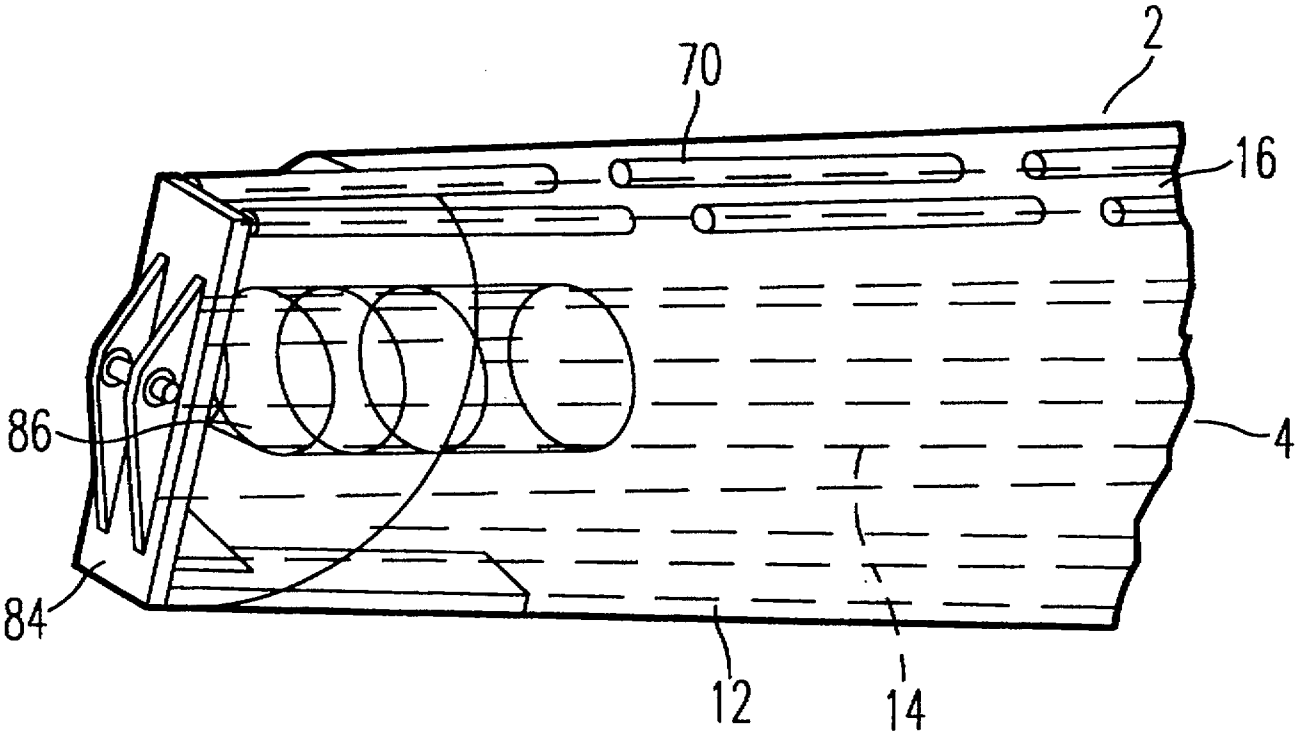
FIG. 2*b*, and 2*c* show a CAD representation of a boom for the roller reefing boom system of FIG. 2*a;*
Figure 2C:
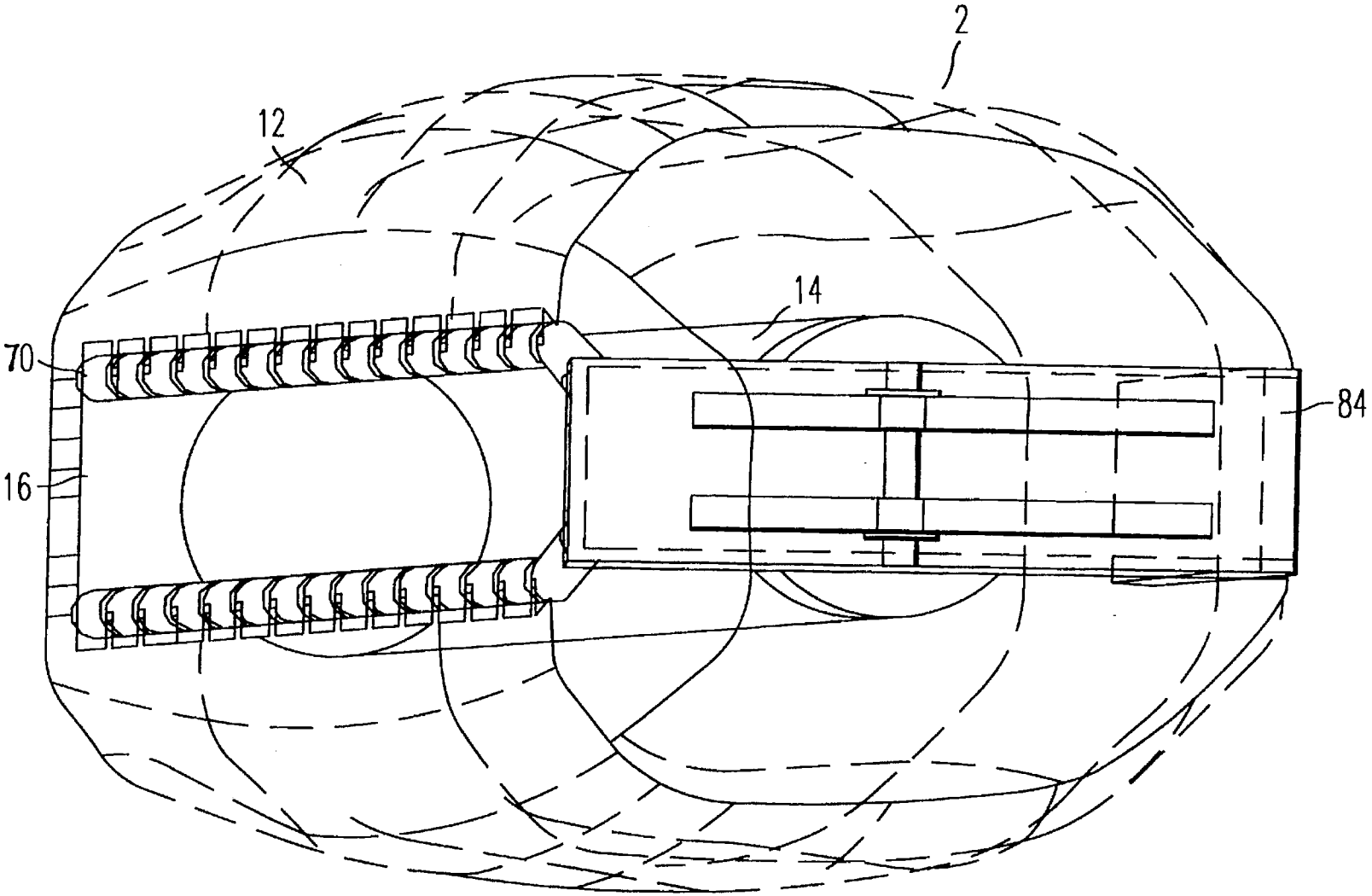

In FIGS. 2*b*, 2*c* CAD drawings of a concrete embodiment of a main boom 4 are represented.

FIG. 2*b* shows the front portion of the boom 4 which is fixed to the mast 2 by the gooseneck fittings 8.

Accordingly, the frame member 12 of the boom 4 includes a boom fitting for the fastening to the mast 2. As already described in the foregoing, rollers 70 extending in sections along the circumferential edge of the slit 16 are pivoted in the area of the slit 16 of the frame member 12 so that the sail cloth is adjacent to the rollers 70 when it is rolled up and unrolled.

The mandrel 14 is supported in the frame member 12, in FIG. 2*b* the support at the side of the boom head fitting being denoted with 86.

FIG. 2*c* shows a side view of the main boom 4 of FIG. 2*a* from which it becomes particularly clear in which way the rollers 70 protrude from the circumferential edge of the slit 16.

As already described in connection with FIG. 1, for setting the mainsail 1 the shown main halyard is set tight so that the mainsail 1 unrolls from the mandrel 14 and is pulled out of the frame member 12.

As already mentioned in the introductory part of the specification, the design according to the invention permits the feeding of a luff rope having a very small diameter into the mast slot 20 of the mast track 18. The luff 27 of the full-batten mainsail according to the invention is only a boltrope 72, as can be deduced particularly from FIGS. 4 and 5.

Figure 5:
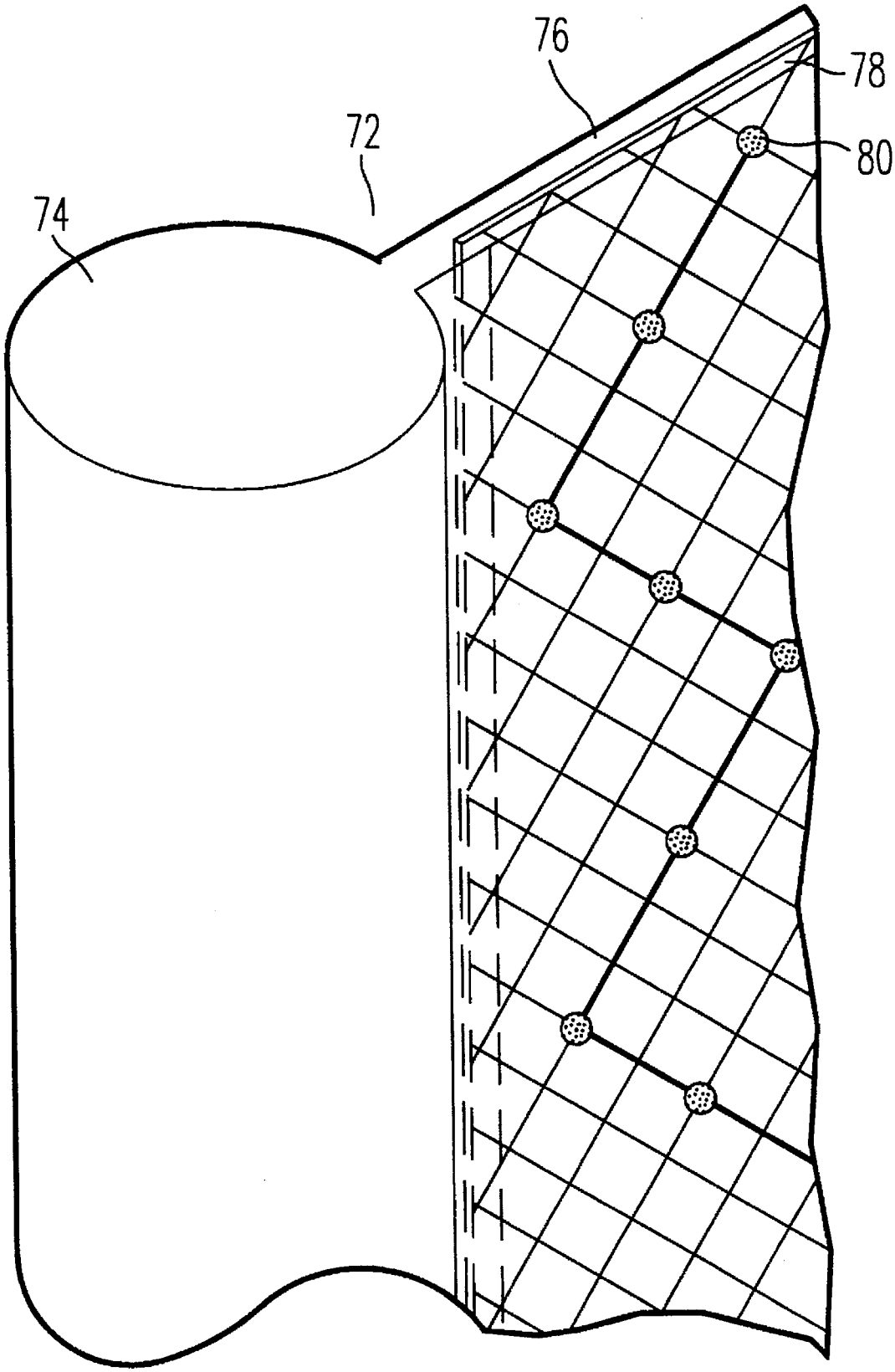
FIG. 5 shows a detailed view of a boltrope portion of the luff of a sail for the roller reefing boom system.

In accordance with FIG. 5, the boltrope comprises a cylindrical portion 74, which is fed into the mast slot 20 and corresponds to the luff ropes used so far, and a luff tape 76, which extends in radial direction away from the cylindrical portion. In the illustrated embodiment the boltrope 72 is manufactured of polyurethane having a Shore hardness of 90 in the extrusion method. It has turned out that this combination of materials has an optimum stability.

The stability of the boltrope 72 can be further increased by introducing a webbing 78 in the luff tape so as to increase the tensile strength and the abrasion resistance of the boltrope 72. The circumferential portion of the sail cloth facing the boltrope 72 (hatched line in FIG. 5) overlaps in sections with the luff tape 76 and is connected with the luff tape by a zigzag seam so that a reliable connection of sail cloth and boltrope 72 of the mainsail 1 for constituting the luff 27 is ensured. In FIG. 5 the needle stitches for linking the thread are marked by the reference numeral 80. The webbing 78 can prevent the stitches of the seam from widening in the luff tape 76 during furling and thus the connection between sail cloth and boltrope 72 from loosening.

Due to the small diameter of the luff 27 formed by the boltrope 72 (FIG. 4), the mast slot 20 must be manufactured with high accuracy so as to safeguard that the luff is reliably kept in the mast track 18 along the total length of the mast slot 20 even in the case of high load. This required accuracy can be achieved by the two-piece design of the mast track according to the invention which is explained in more detail in FIGS. 3 and 4.

Accordingly, the mast track 18 comprises a base track 30 which is fixed to the mast 2 along a supporting surface 32 or to the spring element 22.

A modified dovetail guide in which an insert member 34 is positively guided is formed in the front face of the base track 30 opposite to the support surface 32. In the portion of the insert member 34 which is not enclosed by the dovetail guide the mast slot 20 extending in the known way toward the base track 30 for receiving the luff 27 is formed.

As already mentioned in the beginning, lower demands are made on the base track 30 as regards the dimensional accuracy to be observed, because the dovetail guide for the insert member 34 may have a certain play without substantial drawbacks as to the obtained strength being noted.

The insert member 34, which is more difficult to manufacture and has a considerably lower mass than the base track 30, is manufactured in short sections with high accuracy and is subsequently inserted in the dovetail guide and fastened in the base track 30.

Both the base track 30 and the insert member 34 are aluminium alloys (e.g. AlMgSi) manufactured in the extrusion molding method. The relatively small insert members 34 can be manufactured with considerably higher accuracy, wherein, in the case of rejects, by far less material has to be remelted due to the small mass of the insert members 34 as would be necessary in the case of manufacture of the mast track 18 in one piece.

As can furthermore be taken from FIGS. 3 and 4, the slide 26 is supported on the side faces 36 of the base track 30. In the shown embodiment a slide including a roller bearing is employed the balls 37 of which are guided in a cage 38 of the slide 26.

In the side faces 36 of the base track 30 circular-arc shaped guides 40 are provided for the balls 37.

This guide of the slide 26, which is used per se also in mainsheet travellers, for example, guarantees a nearly friction-free guiding of the slide, wherein extreme forces can be transferred through the balls from the mainsail 1 via the mast track 18 to the mast 2.

The slide 26 bridges a partial section of the mast slot 20 by two support brackets 42 disposed in parallel a distance from each other. An appropriately shaped fixing portion of the headboard 24 can engage in the section between the support brackets 42, a pin which fits tightly in through bores 44 of the support bracket 42 projecting through this connecting portion and the support brackets 42. In this way, the fixing portion of the headboard 24 is pivoted between the support brackets 42.

Figure 6:
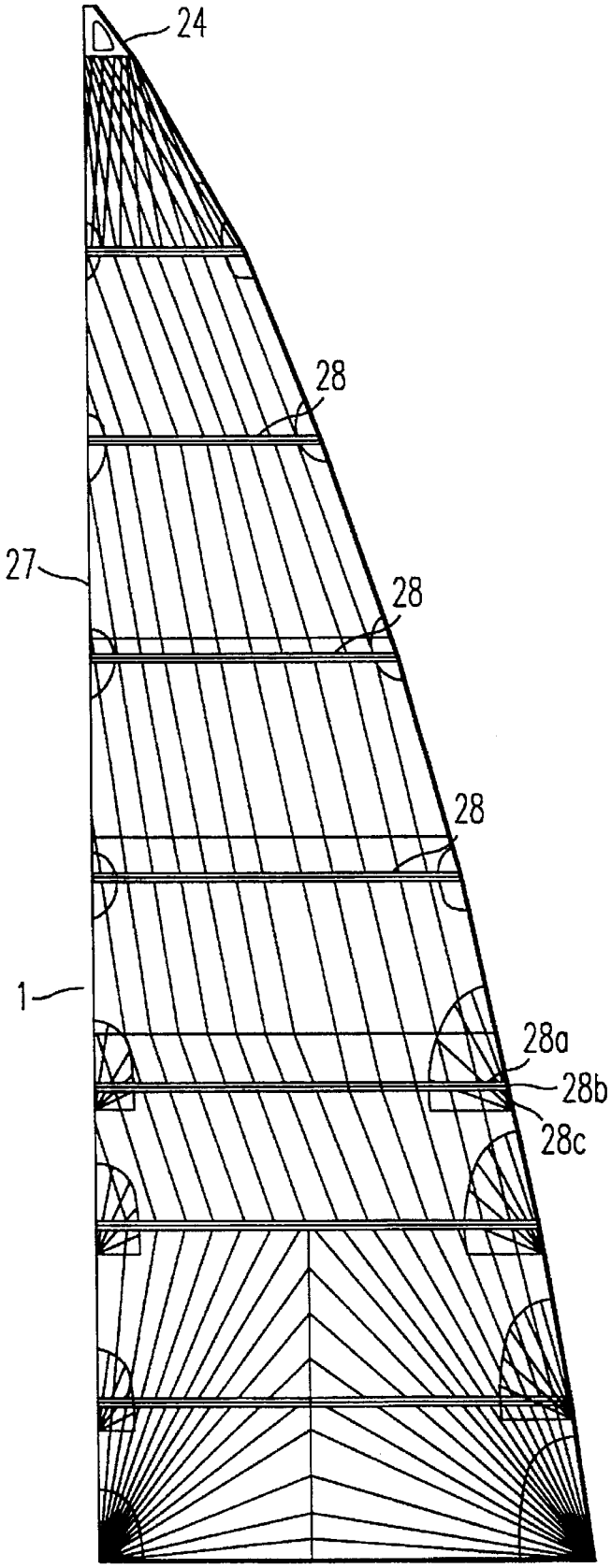
FIG. 6 shows a full-batten mainsail used in the roller reefing boom system.

In FIG. 6 an embodiment of a mainsail 1 is shown as it can be employed in the above-described reefing system.

This mainsail 1 has a triradial cut, battens 28 being provided at predetermined distances. However, in the mainsails used in the reefing system no usual rectangular battens are employed, but each rectangular batten is replaced by a group of round battens, i.e. battens having a circular cross-section. In the shown embodiment one rectangular batten is replaced by three round battens 28*a*, 28*b*, 28*c* disposed a small distance from each other.

These three round battens 28*a*, 28*b*, 28*c* together have about the same flexural strength as one larger rectangular batten so that it is guaranteed that the desired sail shape can be maintained even in heavy air.

When furling the sail into the reefing system it is ensured, however, that each of the round battens is adjacent to a lower winding of the sail so that the sail can be rolled up in a very tight and compact manner.

On the sail shown in FIG. 6 reinforcements determining three reefing positions of the sail are provided at the luff and the leech in the area of the lower three groups of battens. These reinforcements prevent the sensitive cloth layers of the sail from overstretching.

In FIG. 7 once again the forces occurring during reefing and setting of the mainsail 1 are illustrated.

For reefing the mainsail 1 the boom vang 10 is brought into its support position (angle θ) and the mandrel 14 is rotated by the motor 50 and the gear unit 58. At the same time the main halyard is slackened by the motor 66 and the gear unit 62, wherein the already described pretensioning is applied to the luff 27 of the mainsail 1 by the pump effect of the motor 66.

Figure 7:
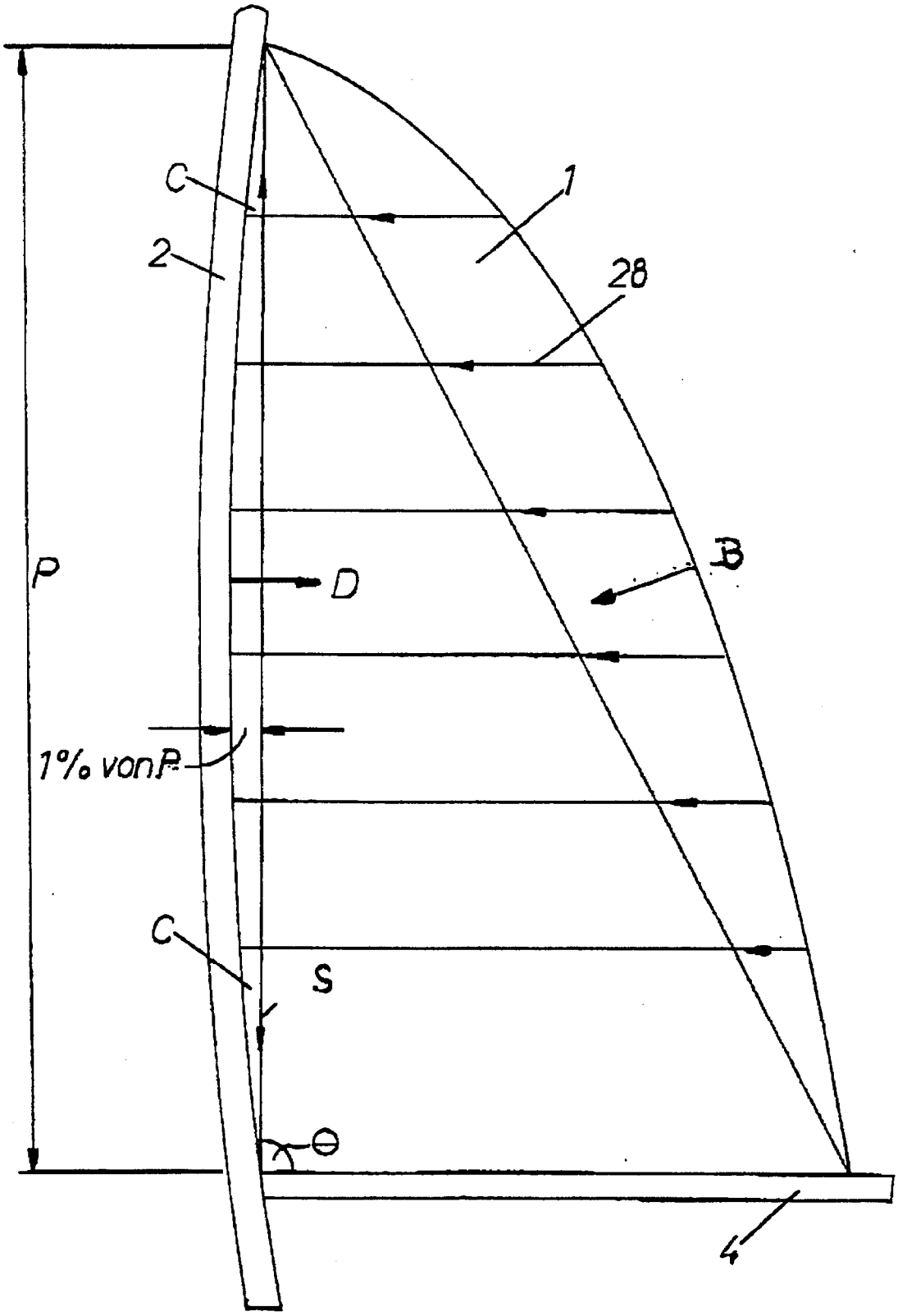
FIG. 7 shows a view of a rig for the roller reefing boom system.

As can be deduced from FIG. 7, the mast 2 has a prebend B that corresponds to about 1% of the luff length P. That is, the mast has a curvature so that the mast slot 20 is distant from the chord S (straight line between mast foot and top) by the dimension figure P at the summit of the curvature.

The luff 27 is deformed by this bend of the mast also in accordance with the bending line of the mast 2. As the sail will endeavor to resume its straight shape in the area of the luff 27 due to the luff tension (in the direction C), a force which urges the battens away from the mast 2 acts in the direction D (FIG. 7) on the luff 27 so that an excessive chafing of the battens at the mast 2 and thus a damage of the sail is prevented.

This force in the direction D acts against the force in the direction B (FIG. 7) applied via the leech by the sheet tension through which the battens are urged to the mast.

Hence the wear of the sail can be reduced to a minimum by the selection according to the invention of the mast bend, the relative position of the boom 4 to the mast 2 (angle θ), the pretension at the luff 27 and the mainsheet tension, if necessary.

During furling the luff can be prevented from moving toward the mast 2 by the above-described luff pretension. In this way, it is ensured that the luff 27 is furled spirally onto the mandrel 14 and thus the layers of the mainsail 1 are close to each other. This tight packing of the mainsail 1 and the self-friction caused thereby between the adjoining sail windings contribute to the fact that the furled sail does not loosen.

By the roller reefing boom system according to the invention, the mast track arrangement 18 and the above-described mainsail 1 and the bend of the mast 2, a system is provided which permits to transfer extremely high mainsheet tensions via the leech to the mast 2 even with a minimum luff diameter. Moreover troublefree furling of the mainsail 1 with a minimum of space is guaranteed by the furling of the sail 1 with a predetermined luff tension via the tensioning means and the predetermined angle of the boom 4 with respect to the mast 2.

There is disclosed a roller reefing boom system, a mast track arrangement, a sail and a rig for use together with said roller reefing boom system which permit to transfer extremely high mainsheet tensions via the leech to the mast even with a minimum luff diameter without the luff being pulled out of the mast slot unintentionally.

Moreover the novel system guarantees troublefree furling of the mainsail with a minimum of space.

We claim:

1. A roller reefing boom system, which comprises:

a mainsail;

a mast having the mainsail mounted thereto;

a pivoted boom connected to the mast, said boom reducing the sail area of the mainsail and about which the mainsail is windable upon reefing of the mainsail;

a mast track connected to the mast, the mast track having a slot formed therein wherein the mainsail is guided along a luff in the slot of the mast track;

a tension transmitting mechanism connected to the mainsail wherein a head area of the mainsail is supported on the mast by said tension transmitting mechanism, said tension transmitting mechanism comprises at least one slide connected to the mainsail and guided along said mast track and wherein said slide is windable with said mainsail about the boom during reefing of the mainsail.

2. A roller reefing boom system according to claim 1, wherein the mast track includes a base track and an insert member fastened to the base track wherein the slot is formed in said insert member.

3. A roller reefing boom system according to claim 2, wherein the insert member is dove-tail fitted to the base track.

4. A roller reefing boom system according to claim 2, wherein the tension transmitting mechanism comprises a slide and wherein said slide bridges the insert member transversely of a longitudinal axis of the insert member and is supported on side faces of the base member.

5. A roller reefing boom system according to claim 4, wherein the slide has roller bearings movably supporting the slide on the insert member.

6. A roller reefing boom system according to claim 1, which comprises a tensioning mechanism applying tension to the main sail during reefing and unrolling of the main sail.

7. A roller reefing boom system according to claim 6, wherein the boom includes a mandrel wherein during reefing the tensioning mechanism acts on the main halyard and/or during unrolling of the sail, the tensioning mechanism acts on the mandrel.

8. A roller reefing boom system according to claim 7, which comprises a main halyard having a motor, a gear unit and halyard drum driven by said motor and said gear unit, wherein during reefing operation the motor acts as a brake through which tensioning occurs.

9. A roller reefing boom system according to claim 7, which comprises a drive unit having a motor through which the mandrel is driven in reefing the mainsail, the motor acting as a brake during unrolling of the sail.

10. A roller reefing boom system according to claim 8, wherein the gear unit comprises a planetary gear.

11. A roller reefing boom system according to claim 1, which comprises a support by which the boom is maintained at an approximately right angle with respect to a longitudinal axis of the mast during reefing operation of the reefing boom.

12. A roller reefing boom system according to claim 11, wherein the angle is 89.7°.

13. A roller reefing boom system according to claim 1, wherein the mainsail comprises a full-batten sail having a plurality of batten sections wherein each batten section comprises a group of battens respectively arranged a predetermined distance from each other.

14. A roller reefing boom system according to claim 13, wherein said group of battens comprises three round battens.

15. A roller reefing boom system according to claim 13, wherein the luff of the mainsail comprises a plastic profile in the form of a boltrope.

16. A roller reefing boom system according to claim 15, wherein the plastic profile has a Shore hardness in the range from 40 to 100.

17. A roller reefing boom system according to claim 15, wherein the plastic profile has a Shore hardness in the range from 40 to 100.

18. A roller reefing boom system according to claim 15, which comprises webbing provided in proximity with a luff tape and located adjacent a cylindrical portion of the plastic profile.

19. A roller reefing boom system according to claim 18, wherein the mainsail is connected to the plastic profile along the luff tape by a zig-zag seam.

20. A roller reefing boom system according to claim 1, wherein the mast is pretensioned and produces a mast bend which corresponds at a deepest point thereof to 0.05 to 5% of a luff length of the sail.

21. A roller reefing system, which comprises:

a mast;

a mainsail mounted on said mast;

a mast track connected to said mast;

a tension transmitting mechanism connected to said mainsail and including at least one slide, wherein a head area of the mainsail is supported on the mast by said tension transmitting mechanism;

said mast track having a slot formed therein guiding the mainsail along a luff and supporting said at least one slide of said tension transmitting mechanism in a head area of said mainsail; and said mast track including a base track and said insert member fastened in said base track, said insert member having said mast slot formed therein and receiving the mainsail luff.

* * * * *

UNITED STATES PATENT AND TRADEMARK OFFICE

CERTIFICATE OF CORRECTION

PATENT NO. : 5,632,215

DATED : May 27, 1997

INVENTOR(S) : Joerg MOESSNANG ET AL.

It is certified that error appears in the above-indentified patent and that said Letters Patent is hereby corrected as shown below:

Column 3, line 48 , change "present" to --prebent--;

Column 5, line 27, change "O" to --Θ--;

Column 6, line 39, change "A slide 26 the whose" to --A slide 26 whose--;

Column 9, line 40, change "unitentionally" to --unintentionally--;

Column 10, lines 47-49, delete in their entirety and renumber remaining claims accordingly.

Signed and Sealed this

Eighteenth Day of November 1997

*Attest:*

Bruce Lehman

BRUCE LEHMAN

*Attesting Officer*

*Commissioner of Patents and Trademarks*